US008892407B2

(12) United States Patent
Budiman et al.

(10) Patent No.: US 8,892,407 B2
(45) Date of Patent: Nov. 18, 2014

(54) ROBUST WELL TRAJECTORY PLANNING

(75) Inventors: Benny S. Budiman, Chantilly, VA (US); Amr S. El-Bakry, Houston, TX (US); Hubert Lane Morehead, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 299 days.

(21) Appl. No.: 13/003,418

(22) PCT Filed: Jul. 2, 2009

(86) PCT No.: PCT/US2009/049594

§ 371 (c)(1),
(2), (4) Date: Jan. 10, 2011

(87) PCT Pub. No.: WO2010/039317

PCT Pub. Date: Apr. 8, 2010

(65) Prior Publication Data

US 2011/0172976 A1 Jul. 14, 2011

Related U.S. Application Data

(60) Provisional application No. 61/101,939, filed on Oct. 1, 2008.

(51) Int. Cl.

| | |
|---|---|
| ***G06F 7/60*** | (2006.01) |
| ***E21B 47/04*** | (2012.01) |
| ***E21B 47/022*** | (2012.01) |

(52) U.S. Cl.

CPC ..... *E21B 47/04* (2013.01); *E21B 47/022* (2013.01)

USPC ..... 703/2; 703/10

(58) Field of Classification Search

None

See application file for complete search history.

(56) References Cited

U.S. PATENT DOCUMENTS 5,468,088 A 11/1995 Shoemaker et al.
5,992,519 A 11/1999 Ramakrishnan et al.

(Continued)

FOREIGN PATENT DOCUMENTS

CA 2312381 6/1999
EP 1230566 11/2000

(Continued)

OTHER PUBLICATIONS

McCann, P. et al. (2003), "Horizontal Well Path Planning and Correction Using Optimization Techniques," *J. of Energy Resources Tech*. 123, pp. 187-193.

(Continued)

*Primary Examiner* — Omar Fernandez Rivas
*Assistant Examiner* — Iftekhar Khan
(74) *Attorney, Agent, or Firm* — ExxonMobil Upstream Research Company Law Dept.

(57) ABSTRACT

A robust well trajectory planning and drilling or completion planning system that integrates well trajectory optimization and well development planning optimization so that optimized solutions are generated simultaneously. The optimization model can consider unknown parameters having uncertainties directly within the optimization model. The model can systematically address uncertain data and well trajectory, for example, comprehensively or even taking all uncertain data into account. Accordingly, the optimization model can provide flexible optimization solutions that remain feasible over an uncertainty space. Once the well trajectory and drilling or completion plan are optimized, final development plans may be generated. Additionally, the optimization model may generate and implement modified well development planning and modified well trajectory in real-time.

22 Claims, 8 Drawing Sheets

(56) References Cited

U.S. PATENT DOCUMENTS

| | | | | |
|---|---|---|---|---|
| 6,035,255 | A | 3/2000 | Murphy et al. | |
| 6,044,328 | A | 3/2000 | Murphy et al. | |
| 6,070,125 | A | 5/2000 | Murphy et al. | |
| 6,236,994 | B1 | 5/2001 | Swartz et al. | |
| 6,373,489 | B1 | 4/2002 | Lu et al. | |
| 6,519,568 | B1 | 2/2003 | Harvey et al. | |
| 6,549,879 | B1 | 4/2003 | Cullick et al. | |
| 6,757,613 | B2 | 6/2004 | Chapman et al. | |
| 6,766,254 | B1 | 7/2004 | Bradford et al. | |
| 6,772,066 | B2 | 8/2004 | Cook | |
| 6,823,266 | B2 | 11/2004 | Czernuszenko et al. | |
| 6,826,483 | B1 | 11/2004 | Anderson et al. | |
| 6,829,570 | B1 | 12/2004 | Thambynayagam et al. | |
| 6,834,732 | B2 | 12/2004 | Haarstad | |
| 6,912,467 | B2 | 6/2005 | Schuette | |
| 6,980,939 | B2 | 12/2005 | Dhir et al. | |
| 6,980,940 | B1 | 12/2005 | Gurpinar et al. | |
| 6,993,434 | B2 | 1/2006 | Cheng et al. | |
| 7,003,439 | B2 | 2/2006 | Alred et al. | |
| 7,027,925 | B2 | 4/2006 | Terentyev et al. | |
| 7,031,842 | B1 | 4/2006 | Musat et al. | |
| 7,050,953 | B2 | 5/2006 | Chiang et al. | |
| 7,079,953 | B2 | 7/2006 | Thorne et al. | |
| 7,181,380 | B2 | 2/2007 | Dusterhoft et al. | |
| 7,281,213 | B2 | 10/2007 | Callegari | |
| 7,283,941 | B2 | 10/2007 | Horowitz et al. | |
| 7,314,588 | B2 | 1/2008 | Blankenship | |
| 7,337,067 | B2 | 2/2008 | Sanstrom | |
| 7,366,616 | B2 | 4/2008 | Bennett et al. | |
| 7,437,358 | B2 | 10/2008 | Arrouye et al. | |
| 7,451,066 | B2 | 11/2008 | Edwards et al. | |
| 7,460,957 | B2 | 12/2008 | Prange et al. | |
| 7,478,024 | B2 | 1/2009 | Gurpinar et al. | |
| 7,512,543 | B2 | 3/2009 | Raghuraman et al. | |
| 7,539,625 | B2 | 5/2009 | Klumpen et al. | |
| 7,548,873 | B2 | 6/2009 | Veeningen et al. | |
| 7,596,481 | B2 | 9/2009 | Zamora et al. | |
| 7,603,264 | B2 | 10/2009 | Zamora et al. | |
| 7,606,666 | B2 | 10/2009 | Repin et al. | |
| 7,616,213 | B2 | 11/2009 | Chuter | |
| 7,627,430 | B2 | 12/2009 | Hawtin | |
| 7,630,914 | B2 | 12/2009 | Veeningen et al. | |
| 7,657,407 | B2 | 2/2010 | Logan | |
| 7,657,414 | B2 | 2/2010 | Zamora et al. | |
| 7,668,700 | B2 | 2/2010 | Erignac et al. | |
| 7,684,929 | B2 | 3/2010 | Prange et al. | |
| 7,725,302 | B2 | 5/2010 | Ayan et al. | |
| 7,796,468 | B2 | 9/2010 | Kellogg | |
| 7,876,705 | B2 | 1/2011 | Gurpinar et al. | |
| 7,913,190 | B2 | 3/2011 | Grimaud et al. | |
| 7,925,483 | B2 | 4/2011 | Xia et al. | |
| 7,991,600 | B2 | 8/2011 | Callegari | |
| 7,995,057 | B2 | 8/2011 | Chuter | |
| 8,094,515 | B2 | 1/2012 | Miller et al. | |
| 8,103,493 | B2 | 1/2012 | Sagert et al. | |
| 8,199,166 | B2 | 6/2012 | Repin et al. | |
| 8,325,179 | B2 | 12/2012 | Murray et al. | |
| 8,346,695 | B2 | 1/2013 | Pepper et al. | |
| 8,364,404 | B2 | 1/2013 | Legendre et al. | |
| 2002/0103630 | A1* | 8/2002 | Aldred et al. | 703/10 |
| 2002/0177955 | A1 | 11/2002 | Jalali et al. | |
| 2005/0119959 | A1 | 6/2005 | Eder | |
| 2006/0151214 | A1* | 7/2006 | Prange et al. | 175/45 |
| 2006/0224423 | A1 | 10/2006 | Sun et al. | |
| 2006/0247903 | A1 | 11/2006 | Schottle et al. | |
| 2007/0156377 | A1 | 7/2007 | Gurpinar et al. | |
| 2007/0168133 | A1* | 7/2007 | Bennett et al. | 702/6 |
| 2007/0199721 | A1 | 8/2007 | Givens et al. | |
| 2007/0266082 | A1 | 11/2007 | McConnell et al. | |
| 2007/0294034 | A1 | 12/2007 | Bratton et al. | |
| 2008/0088621 | A1 | 4/2008 | Grimaud et al. | |
| 2008/0091355 | A1 | 4/2008 | Sanstrom | |
| 2008/0109490 | A1 | 5/2008 | Arnegaard et al. | |
| 2008/0165185 | A1 | 7/2008 | Smith et al. | |
| 2008/0165186 | A1 | 7/2008 | Lin | |
| 2008/0289877 | A1 | 11/2008 | Nikolakis-Mouchas et al. | |
| 2008/0306803 | A1 | 12/2008 | Vaal et al. | |
| 2009/0027380 | A1 | 1/2009 | Rajan et al. | |
| 2009/0027385 | A1 | 1/2009 | Smith | |
| 2009/0037114 | A1 | 2/2009 | Peng et al. | |
| 2009/0043507 | A1 | 2/2009 | Dommisse et al. | |
| 2009/0056935 | A1 | 3/2009 | Prange et al. | |
| 2009/0125362 | A1 | 5/2009 | Reid et al. | |
| 2009/0157367 | A1 | 6/2009 | Meyer et al. | |
| 2009/0182541 | A1 | 7/2009 | Crick et al. | |
| 2009/0200014 | A1 | 8/2009 | Schottle et al. | |
| 2009/0216505 | A1 | 8/2009 | Sarma et al. | |
| 2009/0222742 | A1 | 9/2009 | Pelton et al. | |
| 2009/0295792 | A1 | 12/2009 | Liu et al. | |
| 2009/0299709 | A1 | 12/2009 | Liu | |
| 2009/0303233 | A1 | 12/2009 | Lin et al. | |
| 2010/0171740 | A1 | 7/2010 | Andersen et al. | |
| 2010/0191516 | A1* | 7/2010 | Benish et al. | 703/10 |
| 2010/0206559 | A1 | 8/2010 | Sequeira, Jr. et al. | |
| 2010/0214870 | A1 | 8/2010 | Pepper et al. | |
| 2010/0283788 | A1 | 11/2010 | Rothnemer et al. | |
| 2011/0029293 | A1 | 2/2011 | Petty et al. | |
| 2011/0044532 | A1 | 2/2011 | Holl et al. | |
| 2011/0054857 | A1 | 3/2011 | Moguchaya | |
| 2011/0060572 | A1 | 3/2011 | Brown et al. | |
| 2011/0074766 | A1 | 3/2011 | Page et al. | |
| 2011/0107246 | A1 | 5/2011 | Vik | |
| 2011/0115787 | A1 | 5/2011 | Kadlec | |
| 2011/0153300 | A1 | 6/2011 | Holl et al. | |
| 2011/0161133 | A1 | 6/2011 | Staveley et al. | |
| 2012/0150449 | A1 | 6/2012 | Dobin | |
| 2012/0166166 | A1 | 6/2012 | Czernuszenko | |
| 2012/0285701 | A1* | 11/2012 | Cheng et al. | 166/369 |
| 2013/0338986 | A1* | 12/2013 | Nyrnes et al. | 703/10 |

FOREIGN PATENT DOCUMENTS

| | | |
|---|---|---|
| WO | 99/28767 | 6/1999 |
| WO | 00/14574 | 3/2000 |
| WO | WO 2003/072907 | 9/2003 |
| WO | WO 2003/078794 | 9/2003 |
| WO | WO 2005/020044 | 3/2005 |
| WO | WO 2006/029121 | 3/2006 |
| WO | WO 2007/076044 | 7/2007 |
| WO | WO 2007/100703 | 9/2007 |
| WO | 2008/121950 | 10/2008 |
| WO | 2009/039422 | 3/2009 |
| WO | WO 2009/032416 | 3/2009 |
| WO | WO 2009/079160 | 6/2009 |
| WO | WO 2009/080711 | 7/2009 |
| WO | 2009/148681 | 12/2009 |
| WO | 2011/038221 | 3/2011 |

OTHER PUBLICATIONS

Mugerin, C. et al. (2002), "Well Design Optimization: Implementation in GOCAD," 22nd Gocad Meeting, Jun. 2002, pp.

Rainaud, J.F. et al. (2004), "WOG—Well Optimization by Geosteering: A Pilot Software for Cooperative Modeling on Internet," *Oil & Gas Science & Tech*. 59(4), pp. 427-445.

Reed, P. et al. (2003), "Simplifying Multiobjective Optimization Using Genetic Algorithms," Proceedings of World Water and Environmental Resources Congress, 10 pgs.

Udoh, E. et al. (2003), "Applications of Strategic Optimization Techniques to Development and Management of Oil and Gas Resources," 27th SPE Meeting, 16 pgs.

*European Search Report, dated Jul. 29, 2009, EP 09150617.*

*International Search Report and Written Opinion, dated Aug. 17, 2009, PCT/US2009/049594.*

* cited by examiner

ROBUST WELL TRAJECTORY PLANNING

CROSS-REFERENCE TO RELATED APPLICATION

This application is the National Stage of International Application No. PCT/US2009/049594, that published as WO 2010/039317, filed 2 Jul. 2009, which claims the benefit of U.S. Provisional Application No. 61/101,939, filed 1 Oct. 2008, each of which is incorporated herein by reference, in its entirety, for all purposes.

TECHNICAL FIELD

The present invention relates generally to oil and gas production, and more particularly to integrating well trajectory and well development planning processes.

BACKGROUND

Developing and managing petroleum resources often entails committing large economic investments over many years with an expectation of receiving correspondingly large financial returns. Whether a petroleum reservoir yields profit or loss depends largely upon the strategies and tactics implemented for reservoir development and management. Reservoir development planning involves devising and/or selecting strong strategies and tactics that will yield favorable economic results over the long term.

Reservoir development planning may include making decisions regarding well trajectory, size, timing, and location of production platforms as well as subsequent expansions and connections, for example. Key decisions can involve the trajectory, number, location, allocation to platforms, and timing of wells to be drilled and completed in each field. The planners must also make key decisions concerning drilling and completion properties, such as the number, size, and setting depths of casing strings, sizes of drill pipe, drilling mud densities, flow rates, and required capabilities of surface equipment such as mud pumps. Any one decision or action may have system-wide implications, for example, propagating positive or negative impact across a petroleum operation or a reservoir. Thus, oil and gas well drilling should be a near-flawless operation wherein one or more subsurface targets are penetrated in a near-precise location and with an optimal wellbore orientation while suffering a minimal number of adverse drilling events such as lost circulation, stuck pipe, collisions with other wellbores, etc. In view of the aforementioned aspects of reservoir development planning, which are only a representative few of the many decisions facing a manager of petroleum resources, one can appreciate the value and impact of planning.

Computer-based modeling holds significant potential for reservoir development planning, particularly when combined with advanced mathematical techniques. Computer-based planning tools support making good decisions. One type of planning tool includes methodology for identifying an optimal solution to a set of decisions based on processing various information inputs. For example, an exemplary optimization model may work towards finding solutions that yield the best outcome from known possibilities with a defined set of constraints. Accordingly, a field development plan may achieve great economic benefit via properly applying optimization models for design of wells and for making decisions about the drilling and completion operations that create the wells.

The terms "optimal," "optimizing," "optimize," "optimality," "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms can describe working towards a solution which may be the best available solution, a preferred solution, or a solution that offers a specific benefit within a range of constraints; or continually improving; or refining; or searching for a high point or a maximum for an objective; or processing to reduce a penalty function; etc.

In certain exemplary embodiments, an optimization model can be an algebraic system of functions and equations comprising (1) decision variables of either continuous or integer variety which may be limited to specific domain ranges, (2) constraint equations, which are based on input data (parameters) and the decision variables, that restrict activity of the variables within a specified set of conditions that define feasibility of the optimization problem being addressed, and/or (3) an objective function based on input data (parameters) and the decision variables being optimized, either by maximizing the objective function or minimizing the objective function. In some variations, optimization models may include differential, black-box, and other non-algebraic functions or equations.

Although pivotal in the development plan of oil and gas fields, well trajectory planning has been an exercise of geometry. In conventional reservoir development planning technologies, the resulting well path is an input to the process of determining a well development plan. Frequently, well trajectory planning involves only the process of finding a solution that intersects the target(s) while avoiding other wells, with little or no attempt to optimize anything about the trajectory. The process begins with a well path that is based on a similar geometry from some nearby wells or is composed of interpolating segments joining surface locations and a set of pre-specified targets. This trajectory is input into the plan to drill the well while taking into account some geologic, mechanical and hydraulic constraints. This process may be iterative such that revisions to the trajectory are made in search of a feasible, lower risk, or lower cost plan. However, these revisions to the trajectory have been manual.

The conventional practice for determining a well trajectory is at best a manual process and can be time consuming. Additionally, the finally determined well trajectory may suffer shortcomings, including, but not limited to, lack of conformance to geologic, mechanical, and hydraulic constraints, not providing the best mechanical or economic well trajectory, and having limited capabilities for incorporating drilling environment uncertainty. Thus, the calculated well trajectory may miss an alternate well trajectory that produces a better overall objective, such as minimizing cost or maximizing probability of success.

In view of the foregoing discussion, need is apparent in the art for an improved tool that can aid reservoir development planning and/or that can provide decision support in connection with drilling and completion operations. A need further exists for a tool that can systematically address well trajectory within a model used to produce plans or decision support. A need further exists for a tool that can take into account the geologic, mechanical, and hydraulic constraints when determining the well trajectory. A need further exists for a tool that systematically addresses drilling environment uncertainty within a model used to produce well trajectory, reservoir development plans, and/or decision support. A need further exists for a tool that can integrate well trajectory planning and well development planning processes such that a well path, drilling program, and development plan are generated simultaneously or in concert with one another. The foregoing discussion of need in the art is intended to be representative rather than exhaustive. A technology addressing one or more such needs, or some other related shortcoming in the field, would benefit drilling and reservoir development planning, for example, providing decisions or plans for developing a reservoir more effectively and more profitably.

SUMMARY

The present invention supports making decisions, plans, strategies, and/or tactics for developing petroleum resources, such as a petroleum reservoir. One aspect of the present invention allows for simultaneously generating one or more optimal well trajectories, drilling operations plans, and completion orientations via a computer-based optimization model that may be coupled with a reservoir simulation model or development plan.

In one aspect of the present invention, a computer- or software-based method can provide decision support in connection with drilling and completion plans used for developing one or more petroleum reservoirs. For example, the method can produce well trajectories for a reservoir development plan based on input data relevant to the subsurface formations, the reservoir, and/or the operation. Such input data can include uncertain information whose exact value may be merely known to be within a specified range of values, such as subsurface pore pressures and temperatures, the dimensions of the reservoir, rock strengths, locations of nearby wellbores, and cost per hour of rig time, to name a few representative possibilities. Each element of input data can have an associated level, amount, or indication of uncertainty. Some of the input data may be known with a high level of certainty, such as the current cost of rig time, while other input data may have various degrees of uncertainty. For example, uncertainty of future rig time cost may increase as the amount of time projected into the future increases. That is, the uncertainty of rig time cost for the fifth year of the development plan would likely be higher than the uncertainty of rig time cost for the second year. The collective uncertainties of the input data can define an uncertainty space. A software routine can produce the well trajectories and drilling or completion programs to support the reservoir development plan via processing the input data and taking the uncertainty space into consideration, for example via applying an optimization routine. The drilling process can be represented as a distributed parameter system or model in which the process variables vary as a function of time and space. As a special case, the distributed-parameter models may be approximated as discrete- or lumped-parameter models. Producing the well trajectories and drilling or completion programs can comprise outputting some aspect of a plan, making a determination relevant to generating or changing a plan, or making a recommendation about one or more decisions relevant to reservoir or field development, for example.

The discussion of decision support tools for well planning to support reservoir development presented in this summary is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

Figure 1A:
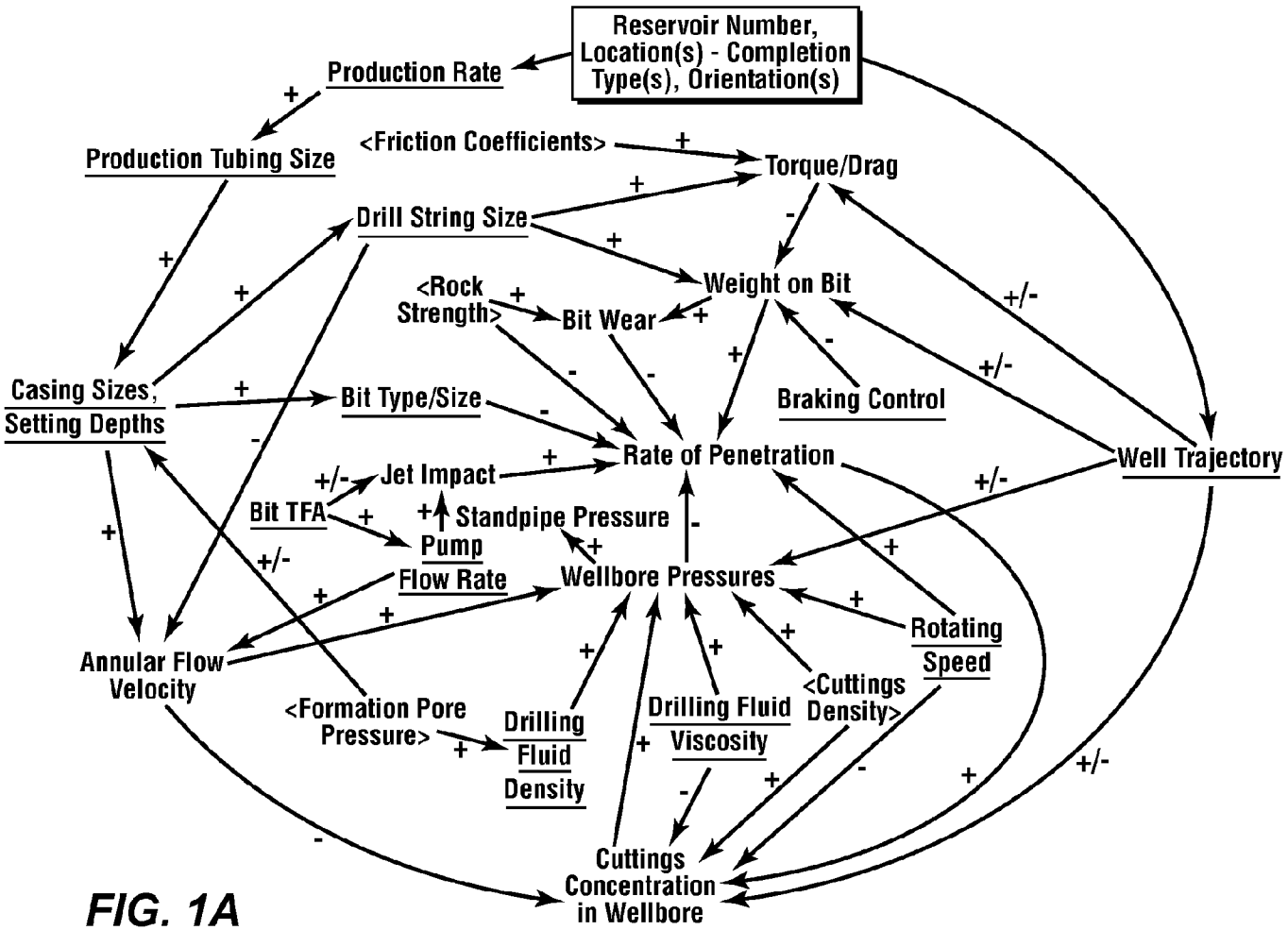
FIG. 1*a* illustrates a drilling influence diagram depicting interactions among drilling variables and shows the effect of wellbore trajectory on some drilling parameters in accordance with certain exemplary embodiments of the present invention.

Many aspects of the present invention can be better understood with reference to the above drawings. The elements and features shown in the drawings are not necessarily to scale, emphasis instead being placed upon clearly illustrating principles of exemplary embodiments of the present invention. Moreover, certain dimensions may be exaggerated to help visually convey such principles. In the drawings, reference numerals designate like or corresponding, but not necessarily identical, elements throughout the several views.

DETAILED DESCRIPTION OF THE EXEMPLARY EMBODIMENTS

Exemplary embodiments of the present invention support making decisions regarding well trajectory designs to support reservoir development planning while details of uncertain parameters remain unknown. Such uncertainties, along with the well trajectory, unfold over time and decisions may need to be made at regular intervals while incorporating the available information in the decision process. These uncertainties and the well trajectory evolve over time and can be considered directly within an optimization model, which may include a Markov decision process-based model, otherwise known as a stochastic dynamic programming model ("SDP"). In an exemplary embodiment, the optimization model systematically addresses all the uncertain data and well trajectory, such that solutions to the well trajectory, drilling or completion program, and reservoir development planning are determined simultaneously. In one embodiment, the uncertainty is represented by transition probabilities that govern transitions between stages, which will be further discussed below. Such a paradigm allows for producing flexible and robust solutions that remain feasible covering the uncertainty space, as well as making the trade-off between optimality and the randomness of uncertainty in the input data to reflect the risk attitude of a decision-maker, which may be either a person or the optimization model itself. Although the following detailed description describes the optimization model being a Markov decision process-based model, other types of optimization models may be used, including, but not limited to, Stochastic decision process-based model and Robust optimization process-based model, without departing from the scope and spirit of the exemplary embodiment.

The optimization model not only incorporates the uncertainty representation and well trajectory and evaluates solution performance explicitly over all scenarios, it also incorporates the flexibility that the decision-maker has in the real world to adjust decisions based on new information obtained over time and space (location or trajectory of the well being drilled). The decision-maker will be able to make corrective decisions/actions based upon this new information. In certain embodiments, this new information may be received by the decision-maker in real time via the use of sensors during drilling. This feature allows for generation of much more flexible and realistic solutions. Additionally, according to one embodiment, the optimization model easily incorporates black box functions for state equations and allows for complex conditional transition probabilities to be used.

The present invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Traditionally, drilling activities for oil and gas wells can be separated into two phases, a design phase and an operational phase. In the design phase, the drilling engineer or design team, which may include geologists, drilling engineers, reservoir engineers, etc., develops a "conceptual" well plan based on their best knowledge about the environment, which includes geologic structures, rock properties, etc. This "conceptual" well plan is used to estimate cost and serves as a baseline for the next phase, which is the operational phase. In the operational phase, actual drilling occurs and the actual drilling plan may deviate from the "conceptual" well plan due to the resolution of at least some of the uncertainties in the environment.

Design Phase

An exemplary embodiment of the present invention will now be described in detail with reference to FIGS. 1-7. According to an exemplary embodiment, candidate well path parameters, such as hole curvatures and kickoff point, and candidate drilling or completion parameters, such as flow rates and weight-on-bit, are provided for each segment of each well, and each parameter may be given a range of allowable values. At least one parameter must be allowed to vary. The decision maker, which is most often the optimization model itself, is permitted to adjust parameters within the defined range to achieve an optimal solution. Each time one or more parameters is changed, a new candidate solution is generated and an objective score is calculated. The objective score may be cost, probability of success, total time to drill the well, etc. The optimization model searches the solution space by adjusting each of the well path parameters and drilling or completion parameters until an optimal, or near-optimal solution is found, where optimal is determined by the objective score for the optimality criterion. The user will have the flexibility to choose the definition of "best", which is the optimality criteria. The problem formulation is a multi-criteria optimization with five distinct classes of optimization components.

The first class of optimization components includes a group of objectives or criteria for optimization. The objectives or criteria for optimization comprise several user defined criteria that make up a multi-objective optimization problem. The criteria may involve, but are not limited to, any one or combination of the following three categories: (1) reservoir performance, (2) well drilling performance, and (3) financial (cost) performance. The reservoir performance category includes, but is not limited to, reservoir response, such as initial or cumulative well production. The well drilling performance category includes, but is not limited to: (a) wellbore stability, (b) probability of drilling success, (c) dogleg severity, (d) cutting mechanics and drill bit wear, (e) mechanical and differential sticking risk, (f) lost return risk, (g) hole cleaning and stuck pipe risk, (h) downhole equipment failure risk, and (i) collision risk. The financial (cost) performance category includes, but is not limited to: (a) measured depth, (b) drilling cost, (c) tripping cost, (d) rate of penetration, (e) number, size, and grade of casing strings, (f) trouble costs, e.g., well control problem, stuck pipe, lost returns), (g) surface equipment and drill rig requirements, e.g., mud pumps, and (h) completion cost.

The second class of optimization components involves a generalized definition of well paths that can be simplified by a sequence of piecewise trajectory segments making up the well path. According to an embodiment, well trajectory is a decision variable much like drilling decisions such as fluid density, fluid viscosity, bottom-hole assembly, flow rate, drill bit, etc. The well trajectory is represented as a sequence of piecewise trajectory segments such as straight line and circular arc. An alternative is to use interpolation curves, such as parabolas, catenaries, splines and kriging interpolation. While somewhat related to a geometric exercise of fitting a curve through a set of target points, this technique is different than a typical geometric exercise. One of the differences is that the calculation of the parametric well trajectory aims to optimize, in a multi-objective sense, the user-defined criteria, which results in a non-inferior set of candidate solutions. Another difference is that the calculation of well trajectory candidates includes uncertain downhole properties (such as friction coefficient) and uncertain geologic properties and structures (including target zone), as well as user controllable drilling parameters. A third difference between this technique and the typical geometric exercise is that this technique also results in drilling plans that make up the non-inferior set of candidate solutions to the multi-objective optimization problem over integrated drilling physics model, as shown in FIGS. 1*a* and 1*b*.

Figure 1B:
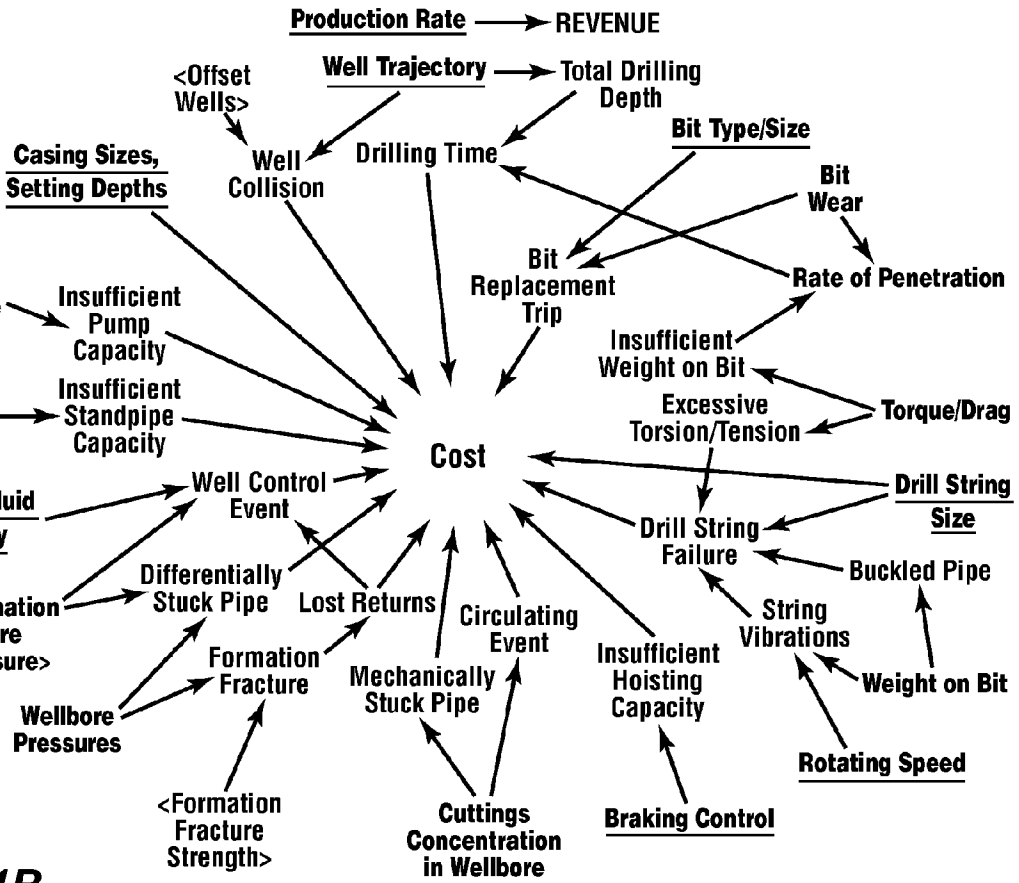
FIG. 1*b* illustrates a continuation of the drilling influence diagram depicting undesirable consequences associated with exceeding certain drilling limits and costs associated with those consequences, as well as costs associated with normal drilling activities, in accordance with certain exemplary embodiments of the present invention.

FIG. 1*a* illustrates a drilling influence diagram depicting interactions among drilling variables and shows the effect of wellbore trajectory on some drilling parameters in accordance with an exemplary embodiment of the present invention. The drilling parameters are shown in underlined text and uncertain properties are shown enclosed in brackets (< >). Additionally, an arrow indicates an influence, with a plus sign (+) indicating that an increase in the influencing parameter results in an increase in the influenced parameter, while a negative sign indicates the opposite effect. For example, an increase in drilling fluid density increases pressure along the wellbore. According to another example, the influence is non-linear, and an increase in bit TFA (total flow area) may either increase or decrease jet impact force. These nonlinear influences, as well as influences that have a spatial dependency and may result in either an increase or decrease in the influenced parameter, are indicated by a plus/minus sign (+/−). Note that FIG. 1*a* does not attempt to incorporate all drilling variables nor all influences, but is intended to illustrate a sampling of these. FIG. 1*b* illustrates a continuation of the drilling influence diagram depicting undesirable consequences associated with exceeding certain drilling limits in accordance with an exemplary embodiment of the present invention. Again, the drilling parameters are shown in underlined text, uncertain properties are enclosed in brackets (< >), items that are repeated from FIG. 1*a* are shown in bold, and arrows indicate an influence. As shown in this continuation diagram, each of the drilling variables ultimately impacts the cost performance of a drilling operation.

The third class of optimization components includes a set of user-defined design variables. The set of user-defined design variables may include, but is not limited to, drilling decisions such as type and size of drill bit, pump flow rate, drilling fluid density, drill string rotation speed, etc. According to current practices, these design variables are calculated to satisfy a criterion subject to a predefined well path. According to an exemplary embodiment, however, the design variables are determined simultaneously with calculation of the candidate well paths such that together a set of criteria, including the trajectory well path, are optimized.

The fourth class of optimization components involves a set of calculated values and their corresponding limits that provide constraints or limits on well trajectory and well drilling indicators/variables. The set of constraints or limits on well trajectory and well drilling indicators/variables ensures feasibility of the candidate trajectories and set of drilling design variables in drilling wells. This set of calculated values includes, but is not limited to, standpipe pressure, wellbore pressure, cuttings concentration, cuttings bed height, drill string torque, drill string tension, and bit wear. According to an exemplary embodiment, both hard enforcement of these constraints and determination of probability of success, i.e., probability of these indicators being within the allowable limits, are allowed.

The fifth class of optimization components includes a set of uncertain geological properties or non-constant drilling parameters of which value can be represented as random variables of assumed probability distributions. This set includes, but is not limited to, formation pore pressure, rock strength, fracture limit, wellbore temperature, friction coefficient, cuttings density, and the actual location of nearby wells and the location of the well that is being planned.

The crux of drilling is to bore through rock to make a passage for oil and gas to flow to the surface. The drilling process may be considered to be sequential since the drill bit advances inch-by-inch to generate passage for hydrocarbons to the surface. Drilling issues, once encountered, may significantly slow down or cease advancing the drill bit and must be resolved before the operation can be resumed. Encountering a drilling issue amounts to being in an "off state" while a trouble-free advancement of the drill bit is considered to be an "on state." The advancement may also be in an "off state" when the drill bit cannot advance significantly beyond the present location until the issue is resolved. Without resolving the issue, continued advancement may result in a catastrophic or unrecoverable failure.

Figure 2:
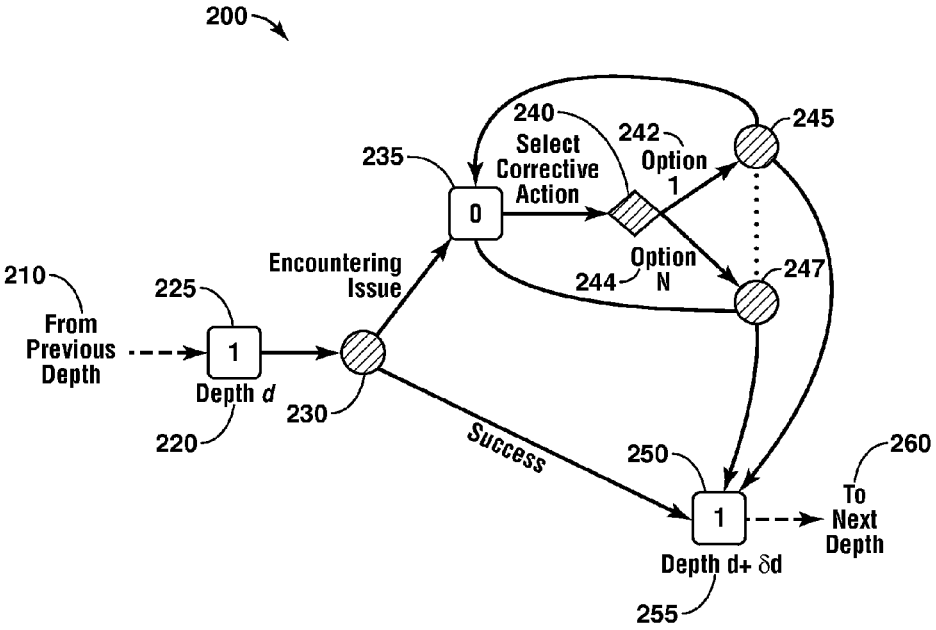
FIG. 2 illustrates a diagram showing drilling as a sequential process wherein the drill bit advances inch-by-inch to reach pay zones for extracting hydrocarbons in accordance with certain exemplary embodiments of the present invention.

FIG. 2 illustrates drilling as a sequential process wherein the drill bit advances inch-by-inch to reach pay zones for extracting hydrocarbons in accordance with an exemplary embodiment of the present invention. A rounded square indicates a drilling state, which may be represented with a "1" for "on state" and a "0" for "off state". A circle indicates encountering uncertain outcomes which may involve encountering an issue. A diamond shows a decision junction involving one or more choices for resolving the issue.

According to the fifth class of optimization components, there is a non-zero probability of transitioning from the "on state" to the "off state" and from an "off state" to an "on state." In an exemplary embodiment, this non-zero probability of transitioning lends itself to a Markov-like model. In this model, the wellbore trajectory is also computed rather than being predetermined and imposed as in existing drilling optimization solutions.

During the drilling process, drilling decisions, including, but not limited to, drilling fluid density and viscosity, pump flow rate, bit TFA, bottom hole assembly, drill string rotation speed, weight-on-bit, drill bit type, and drilling direction/trajectory, are made to reach targets as fast as possible while avoiding drilling issues to keep cost down. In most cases, the total cost to drill a well is reduced by drilling slower than would normally be possible. Some of these drilling decisions are made only once for the entire operation, such as the maximum pumping or hoisting capacity, while others are modified very infrequently. Thus, multiple optimality criteria may be optimized over the entire total depth drilled.

In FIG. 2, the drilling process advances sequentially from a previous depth 210. As the drilling process 200 advances to depth d 220, the drilling process 200 is still in an "on state" 225. The drilling process 200 continues beyond depth d 220 and encounters an uncertain outcome 230. Although not illustrated in FIG. 2, a certain probability exists for encountering this uncertain outcome 230. At this uncertain outcome 230, an issue may be encountered which causes the drilling process 200 to change to an "off state" 235. At "off state" 235, a decision-maker may elect a certain decision at a decision junction 240, which may have one or more alternate choices, which are shown by option 1 242 to option N 244. Each decision involves a probability for advancing the drilling process 200 to another uncertain outcome 245, 247, resulting in the drilling process 200 proceeding to an "on state" 250 at depth d+δd 255. The drilling process 200 then proceeds to the next depth 260 until another drilling issue is encountered or until the final drill depth is reached.

One example of a mathematical formulation for a sequential drilling process is described below. A nonempty state space X represents the states of drilling as well as other drilling states such as hole geometry, cuttings accumulation, conditions of drill bit, etc. The state space X is bounded and has a defined range of admissibility. A nonempty action space U(x) is defined for each state $x \epsilon X$. Action points $u(x) \epsilon U(x)$ involve drilling decision variables such as well trajectory, pump rate, weight-on-bit, rotation speed, drilling fluid density and viscosity, etc. The uncertain parameters in drilling typically depend on the state space. For completeness, they may also be assumed to depend on the action spaces. These parameters are members of a finite, nonempty environment space $\Omega(x,u)$, for each $x \epsilon X$ and $u \epsilon U$. Drilling is assumed to occur in discrete stages, each denoted by k. A probabilistic model may be used to represent the uncertain parameters and the probability distribution of the uncertain parameters may be assumed to be Markovian, i.e., $$P(\omega_k|\tilde{x}_k,\tilde{u}_k)=P(\omega_k|x_k,u_k), \tag{1}$$

where P is the probability distribution function of $\omega\epsilon\Omega(x, u)$, $\tilde{x}_{K+1}=(x_1, x_2, \ldots, x_{K+1})$ is the history of the states, and $\tilde{u}_K=(u_1, u_2, \ldots, u_K)$ is the history of the action variables.

This definition states that only the present state provides any information of the future behavior of the process. Knowledge of the history of the process does not add any new information for determining a probable future behavior of the process.

The drilling process may be modeled as a Markov process, a stochastic process which possesses the Markovian property described above, with a state transition function $f$ that generates a next state $f(x,u,\omega))$ for every $x\epsilon X$, $u\epsilon U$, and $\omega\epsilon\Omega(x, u)$. Since drilling is assumed to be conducted in discrete stages, the state in the next stage k+1 given $x_k$, $u_k$, $\omega_k$ is $$x_{k+1}=f(x_k,u_k,\omega_k) \tag{2}$$

Typically, a drilling engineer does not know the actual value of the uncertain geologic and drilling parameters $\omega_k$. Therefore, applying $u_k$ given the state $x_k$ results in a set of states defined as $$X_{k+1}(x_k,u_k)=\{x_{k+1}\epsilon X|\exists\omega_k\epsilon\Omega(x_k,u_k) \text{ such that } x_{k+1}=f(x_k,u_k,\omega_k)\} \tag{3}$$

The geologic targets and intermediate targets make up the goal set $X_G\subset X$. The last target is completed in K+1 stages. The optimal criteria is expressed as a vector-valued stage-additive cost functional L defined as $$L(\tilde{x}_{K+1}, \tilde{u}_K, \tilde{\omega}_K) = \sum_{k=1}^{K} l(x_k, u_k, \omega_k) + l_{K+1}(x_{K+1}) \tag{4}$$

where $\tilde{x}_{K+1}=(x_1, x_2, \ldots, x_{K+1})$ is the history of the states;

$\tilde{u}_K=(u_1, u_2, \ldots, u_K)$ is the history of the action variables; and $\tilde{\omega}_K=(\omega_1, \omega_2, \ldots, \omega_K)$ is the history of the environment variables.

The formulation of equation (4) is also referred to as a Markov decision process.

In drilling applications, the cost functions in equation (4) are not dependent on the environment, i.e., $l(x_k,u_k,\omega_k)=l(x_k, u_k)$. To avoid explicit dependency on the uncertain geologic and drilling parameters, a probability distribution over X, $P(x_{k+1}|x_k,u_k)$, is defined as the alternative to the state transition equation when the uncertain geologic and drilling parameters are modeled as probability distribution. Imposing the limits or constraints over the probability distribution above can be further simplified as probability of success. Despite this fact, the formulation will continue to include explicit dependency on nature as described in equation (4). The formulation may be modified, as appropriate, according to the specific application.

In optimal drilling planning, one of the goals is to compute a set of plans that are feasible and non-inferior with respect to the set of optimal criteria, as defined previously. Given uncertain environment conditions, the Pareto optimal strategies either minimize regrets, the worst case:

$$\tilde{u}_K^* = \underset{\tilde{u}_K\in U}{\arg inf}\left\{\underset{\omega_K\in\Omega}{sup}\, L(\tilde{x}_{K+1}, \tilde{u}_K, \tilde{\omega}_K)\right\} \tag{5}$$

or minimize cost:

$$\tilde{u}_K^* = \underset{\tilde{u}_K\in U}{\arg inf}\{E_{\tilde{\omega}K}[L(\tilde{x}_{K+1}, \tilde{u}_K, \tilde{\omega}_K)]\} \tag{6}$$

Equation (4) is solved using stochastic dynamic programming that requires rewriting in terms of the cost-to-go function. The minimal-regret cost-to-go function from state $x_k$ is given by:

$$G_k^*(x_k) = \underset{u_K\in U(x_k)}{inf}\left\{\underset{\omega_k}{sup}[l(x_k, u_k, \omega_k) + G_{k+1}^*(x_{k+1})]\right\} \tag{7}$$

The minimal average cost-to-go function for equation (4) is given by:

$$G_k^*(x_k) = \underset{u_k\in U(x_k)}{inf}\{E_{\omega K}[l(x_k, u_k, \omega_k) + G_{k+1}^*(x_{k+1})]\} \tag{8}$$

In both formulations, limits or constraints on the control actions as well as the drilling states may be imposed. These limits or constraints are commonly represented as:

$$C_1(\tilde{x}_{K+1})\leq 0$$

$$C_2(\tilde{u}_K)\leq 0 \tag{9}$$

In equation (9), $C_1(\tilde{x}_{K+1})$ and $C_2(\tilde{u}_K)$ are vector-valued functions imposing limits on the state and design variables, respectively. The mathematical formulation to generate and evaluate Pareto optimal drill plans involves either equation (7) or (8) along with the state transition equation (2) and a set of vector-valued functions in equation (9) imposing limits or constraints on the state and design drilling variables.

Operational Phase

During the operational phase, new information is obtained to reduce or resolve the uncertainty in the environment. For example, the drilling crew may encounter geologic conditions that are different from those used during the design phase. When this new information is obtained in the operational phase, it may be used to calibrate the optimization model given by equations (2), (7), (8), and (9), from above.

The new information may be gathered from different sources that include, but not limited to, sensors, analysis of rock cuttings or drilling and bore data, and well logs. The new information may also include the location of the drill bit based on gyroscopic, inertial, gravity-based, and/or magnetic down-hole positional measurements. The calibrated model enables fine tuning of the plan during actual drilling, i.e., recalculation of decision or control drilling variables. The recalculation of design or control variables may be performed by several techniques, including the receding horizon optimization. The real-time calculated control drilling variables optimize the objective-to-go, from the current location of the bit to the final target zone.

According to one embodiment, the new information may be manually inputted into the model. In an alternative embodiment, the new information is automatically entered into the model via the different sources so that the model can immediately generate and implement a modified optimal well trajectory and modified well development plan.

Computer Program

The present invention can include multiple processes that can be implemented with one or more computers and/or manual operation. The present invention can comprise one or more computer programs that embody certain functions described herein. However, it should be apparent that there could be many different ways of implementing aspects of the present invention with computer programming, manually, non-computer-based machines, or in a combination of computer and manual implementation. The invention should not be construed as limited to any one set of computer program instructions. Further, a programmer with ordinary skill would be able to write such computer programs without difficulty or undue experimentation based on the disclosure and teaching presented herein. Therefore, disclosure of a particular set of program code instructions is not considered necessary for an adequate understanding of how to make and use the present invention.

According to one embodiment, the techniques described above may be applied using one or more computer programs that contain (a) storage media and interface to the storage media; (b) user and data interface; (c) lists of variables that are used in the calculations; (d) set of engineering calculations and limits for calculated data; (e) set of objective calculations, e.g., cost calculations; (f) look-up tables, charts, monographs, or other data sources to be used in the calculations; (g) optimization algorithms; (h) sensitivity algorithms; (i) iterative solution algorithms, also known as "solvers"; and (j) controller program that integrates all of the previously mentioned components.

The storage media is typically a hard disk drive containing files. Although one embodiment depicts the storage media to be a hard disk drive, the storage media may include, but not limited to, other electronic storage devices without departing from the scope and spirit of the exemplary embodiment. The interface to the storage media facilitates storage and retrieval of input data, user configurations and options, and results.

The user and data interface to the program may be a graphical user interface, file based interface, and/or a real-time data interface establishing communication from sensors and to actuators. The user and data interface allows the user to enter data and make selections that affect the calculations and the way in which results are presented. The user and data interface can also be used to read real-time data or field measurements that can be used in the program for real-time optimization decisions.

The variables list allows the user to enter parameter values that are used in the calculations, for example flow rate. The variables list also allows the user to select design variables that can be varied by the program, such as rotation speed and well trajectory, along with minimum and maximum allowable values for each design variable. Finally, the variables list allows the user to select nature variables whose values are subject to uncertainty, such as pore pressure, and to specify their probability distribution. For example, the user may specify the most probable value for pore pressure, as a function of depth, along with a minimum and a maximum value, or a percent variation, and a distribution type, such as uniform, triangular, or parabolic. Upper and lower limits for design variables and uncertain nature variables can be defined by the user, calculated by the program, or obtained through a look-up method from tables of data that are available to the program. For example, the maximum allowable flow rate may be based on the maximum allowable strokes per minute for a pump that is chosen by the user or by the optimization algorithm.

Engineering calculations include algorithms for determining such values as wellbore pressures and temperatures, predicted fracture gradient, torque and drag, rate of penetration, unless specified by the user, cuttings carrying capacity, etc. These calculated data may also have limits imposed; for example, the calculated torque in the drill string may not exceed the makeup torque, and the calculated wellbore pressure cannot exceed the formation fracture gradient.

The set of objectives calculations are used to determine results whose values are being optimized, such as cost. Many of these calculations are built into the program with the user allowed to vary only selected parameters used in the calculations, In other cases, the user can create his custom objective calculation(s) using the list of available design variables and calculated variables as inputs to the calculations.

Lookup tables, charts, and other data sources contain information that can be used by the program as inputs. Some of these have been mentioned above, such as pore pressure data or formation data. They may also include "catalog" data from which the user or program may choose, such as bit sizes, casing sizes, available pumps and capacities, or cost data. The data may be discrete, such as the examples just cited, or continuous, allowing the program to interpolate using the published data, such as mud properties that are dependent on pressure and temperature.

Optimization algorithms are used to generate the Pareto optimal drilling plans by solving either equation (7) or (8) along with the state transition equation (2) and the set of constraints given in equation (9). Optimization algorithms may be chosen based on the specific properties of all the functions included in equations (7), (8), (2), and (9).

Sensitivity algorithms are used to calculate and display variable information that assists the user in making a decision about how to proceed. In this respect, the user may decide to choose a feasible and non-dominated design that is not the "optimal" solution determined by the program. This decision may be based on information that was not provided to the program, but based on professional judgments.

Iterative solution algorithms and solvers are used within the program for calculations that do not have a simple closed form solution or for calculations that are coupled. For example, in a closed-loop system, the calculated temperature of the drilling fluid as it exits the wellbore depends on the inlet temperature of the fluid. However, the inlet temperature is calculated based on the temperature of the fluid as it exits the wellbore. An iterative solver is used to determine the steady-state temperatures for the fluid as it enters and exits the wellbore.

Finally, the controller program of the application integrates all of the other components. It receives the data from the user, the files, or the field sensors, passes the data to and among each of the calculation engines, and provides the final results to the user or to some other recipient of the data.

In practice, the user may provide all input, review all results, and make decisions based on his review of the data that is provided by the program. In another embodiment, much of the input data is derived from sensors in the field and provided to the program. The program then automatically adjusts one or more design variables, such as flow rate, rotary speed, or weight-on-bit, to maintain optimal performance during actual operations. In this embodiment, the program may also advise a user/operator of impending problems and suggest a possible cause and solution.

EXAMPLE

The example given in this section involves deterministic well path optimization with an objective to minimize the length of the well trajectory, or well path, that lies on a two-dimensional (2-D) plane such that all points along the well path have the same azimuth. The illustration of this example is not meant to be limiting in any manner.

Figure 3:
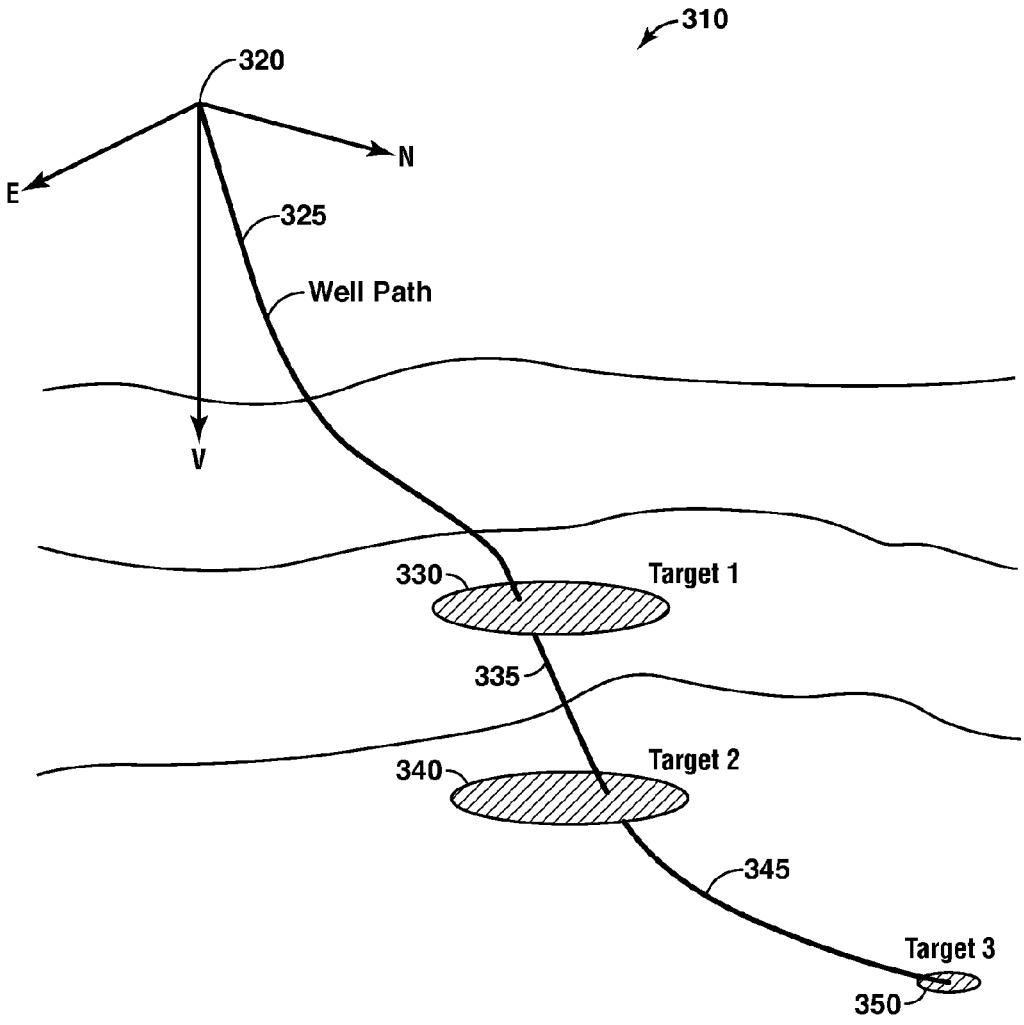
FIG. 3 illustrates a well path proceeding through multiple geological targets in accordance with certain exemplary embodiments of the invention.

FIG. 3 illustrates a well path proceeding through multiple geological targets in accordance with an exemplary embodiment of the invention. The well path 310 is shown to proceed from a first location 320 to a target 1 330, further proceeding to a target 2 340, and further proceeding to a target 3 350. The well path 310 consists of multiple discretized segments 325, 335, 345, wherein each discretized segment 325, 335, 345 connects two consecutive geologic targets. The first discretized segment 325 connects the first location 320 to the target 1 330. The second discretized segment 335 connects the target 1 330 to the target 2 340. The third discretized segment 345 connects the target 2 340 to the target 3 350. Also, each discretized segment 325, 335, 345 consists of a series of five sub-segments, which include a first straight-line sub-segment, a second circular-arc sub-segment, a third straight-line sub-segment, a fourth circular-arc sub-segment, and a fifth straight-line sub-segment. Any of these five sub-segments may optimally be of zero length. In addition, one or more of the geologic targets may be defined as a point in space that is specified by either the user or by the model to influence the well trajectory, for example to avoid collision with another well.

Figure 4:
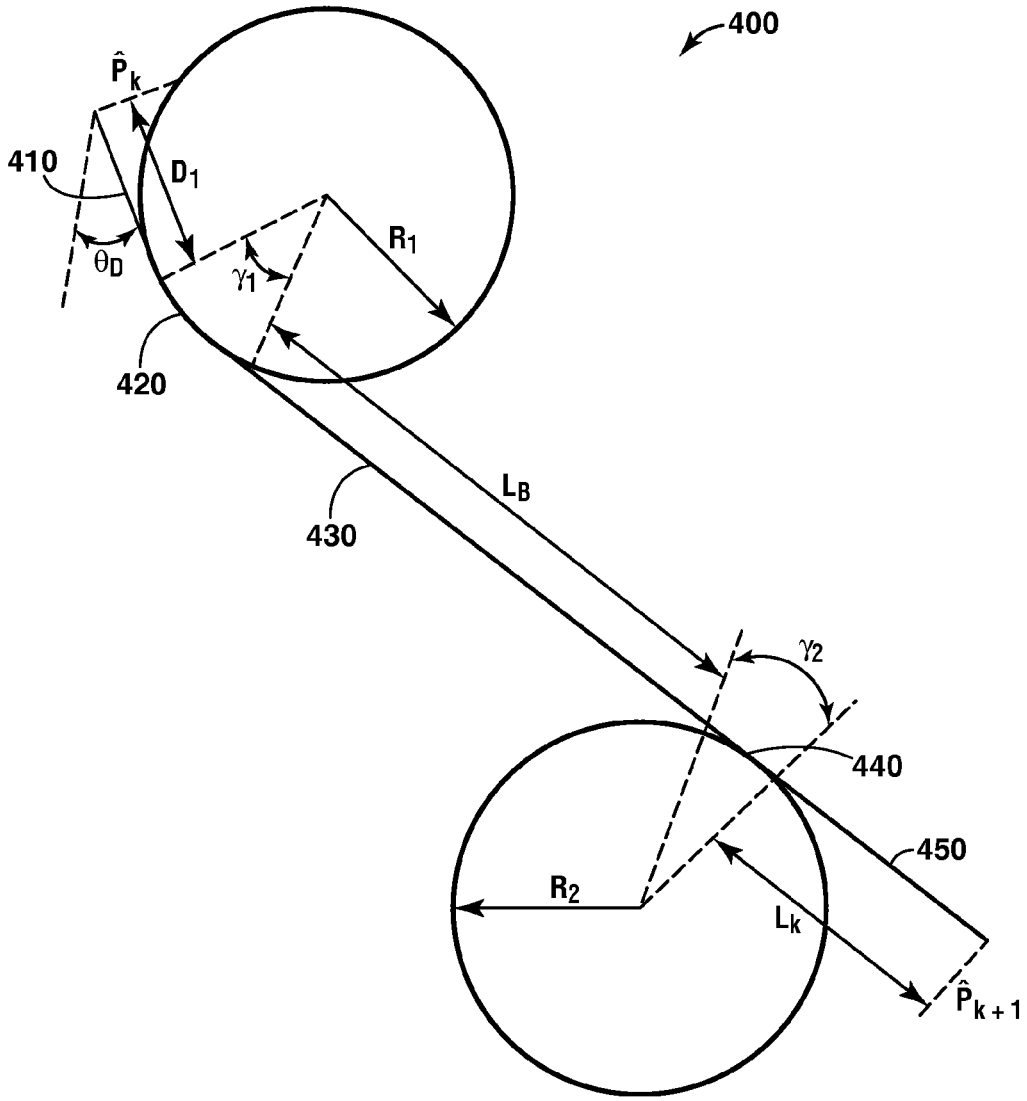
FIG. 4 illustrates the five sub-segments that form an exemplary discretized segment connecting two consecutive geologic targets in accordance with certain exemplary embodiments of the invention.

FIG. 4 illustrates the five sub-segments that form an exemplary discretized segment connecting two consecutive geologic targets in accordance with an exemplary embodiment of the invention. As previously mentioned, each discretized segment 400 of a well path comprises five sub-segments, which include a first straight-line sub-segment 410, a second circular-arc sub-segment 420, a third straight-line sub-segment 430, a fourth circular-arc sub-segment 440, and a fifth straight-line sub-segment 450. Any one of these five sub-segments may optimally be of zero length.

Figure 5:
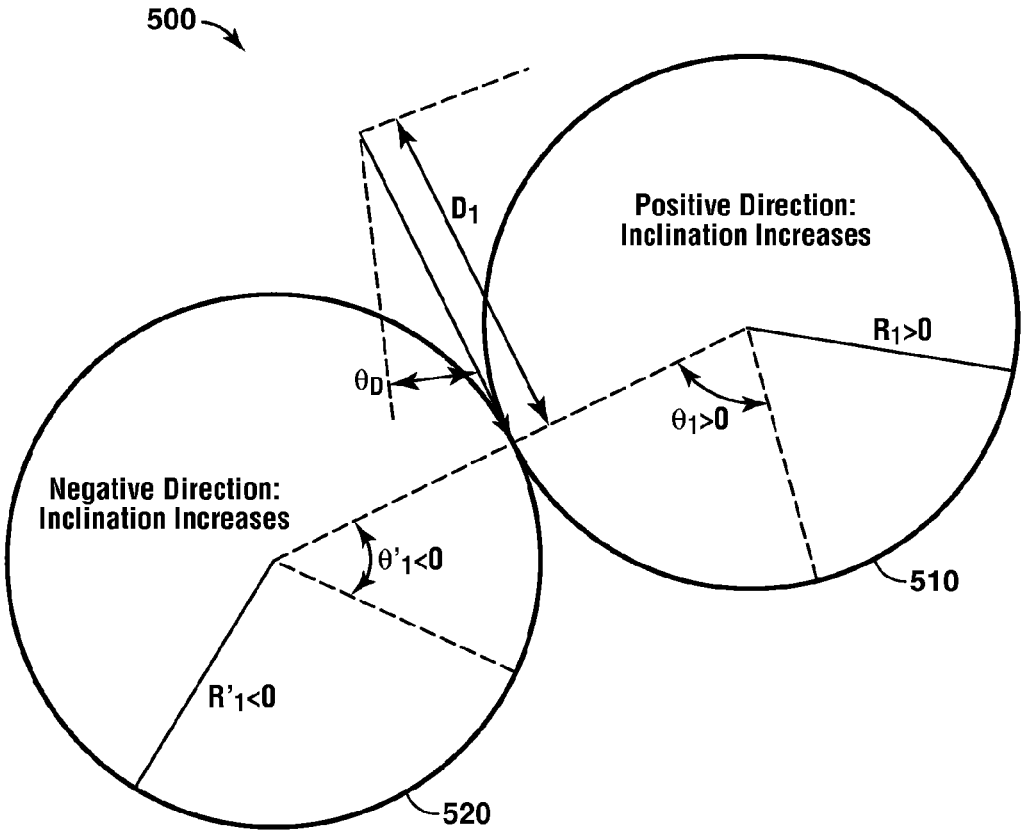
FIG. 5 illustrates the sign convention for the circular arc sub-segment in accordance with certain two-dimensional exemplary embodiments of the invention.

FIG. 5 illustrates the sign convention for the circular arc sub-segment in accordance with an exemplary embodiment of the invention. The sign convention describes the build direction of the particular circular arc sub-segment. If the sign convention for the circular arc sub-segment 500 is positive 510, the inclination increases. However, if the sign convention for the circular arc sub-segment 500 is negative 520, the inclination decreases.

Referring to FIGS. 4-5, according to this example, the drilling states are geometric and include the parameters describing the sub-segments: length and inclination ($D_{1,k}$, $\theta_{D,k}$) of the first straight-line sub-segment, direction angle and radius ($\gamma_{1,k}$, $R_{1,k}$) of the second circular-arc sub-segment, length ($L_{B,k}$) of the third straight-line sub-segment, direction angle and radius ($\gamma_{2,k}$, $R_{2,k}$) of the fourth circular-arc sub-segment, and length ($L_{F,k}$) of the fifth straight-line sub-segment. These parameters are grouped into a set of geometric parameters:

$$C_k=\{D_{1,k},\theta_{D,k},\gamma_{1,k},R_{1,k},L_{B,k},\gamma_{2,k},R_{2,k},L_{F,k}\} \tag{10}$$

The states also include coordinates ($\hat{x}_k$, $\hat{y}_k$) of the starting point $\hat{P}_k$ of the segment. This example assumes no uncertain nature.

The optimization problem is posed as one that minimizes the length of the well path. In addition to minimizing length, deviation from geologic targets is also minimized. The optimization criterion, however, is a weighted sum of the two objectives. The multi-criteria optimization problem is simplified by combining the two objectives in a weighted sum. An alternative would be to consider both objectives separately and solve for a set of paret optimal candidate solutions. The single optimization criterion is expressed as the following dynamic program:

$$J_k^*(\hat{x}_k,\hat{y}_k)=\min_{C_k}\{S_k(C_k,\hat{x}_k,\hat{y}_k)+J_{k+1}^*(\hat{x}_{k+1},\hat{y}_{k+1})\}$$

where, $$S_k(C_k,\hat{x}_k,\hat{y}_k)=\alpha_{L,k}(D_{1,k}+\gamma_{1,k}R_{1,k}+L_{B,k}+\gamma_{2,k}R_{2,k}+L_{F,k})+\alpha_{\Delta,k}G_k(\hat{x}_{k+1},\hat{y}_{k+1},x_{k+1},y_{k+1});$$

($x_{k+1}$, $y_{k+1}$) is the target coordinates for the k-th segment;

$$\hat{x}_{k+1}=\hat{x}_k+D_{1,k}\sin\theta_{D,k}+R_{1,k}[\cos\theta_{D,k}-\cos(\theta_{D,k}+\gamma_{1,k})]+L_{B,k}\sin(\theta_{D,k}+\gamma_{1,k})+R_{2,k}[\cos(\theta_{D,k}+\gamma_{1,k})-\cos(\theta_{D,k}+\gamma_{1,k}+\gamma_{2,k})]+L_{F,k}\sin(\theta_{D,k}+\gamma_{1,k}+\gamma_{2,k})$$

$$\hat{y}_{k+1}=\hat{y}_k+D_{1,k}\cos\theta_{D,k}-R_{1,k}[\sin\theta_{D,k}-\sin(\theta_{D,k}+\gamma_{1,k})]+L_{B,k}\cos(\theta_{D,k}+\gamma_{1,k})-R_{2,k}[\sin(\theta_{D,k}+\gamma_{1,k})-\sin(\theta_{D,k}+\gamma_{1,k}+\gamma_{2,k})]+L_{F,k}\cos(\theta_{D,k}+\gamma_{1,k}+\gamma_{2,k}) \tag{11}$$

There are only geometric limits imposed on this problem. Physically, one of the limits restricts dogleg severity (DLS) during build to ensure feasibility of the solution. In addition, non-negative length of the circular-arc sub-segments and restriction on the inclination angles are imposed. These constraints are expressed as:

$$\begin{aligned}&0\le D_{1,k}\le D_{Total}\\&-\pi/2\le\theta_{D,k},\gamma_{1,k},\gamma_{2,k}\le\pi/2\\&0\le\gamma_{i,k}R_{i,k},\ i=1,2\\&|R_{i,k}|\ge F(\mathrm{DLS}),\ i=1,2\end{aligned} \tag{12}$$

The following numerical example illustrates the application of the above dynamic programming approach to solve for an optimal well path to reach a geologic target for a specified set of limits and initial conditions. The numerical solutions were obtained using the FMINCON function on Matlab™ and summarized in Table 1 below.

TABLE 1

Optimal well path to reach a geologic target from a fixed surface location defined as $P_1$ (0, 0)

| Target | Constraints | Results | | |
|---|---|---|---|---|
| | | Path 1 | | |
| $P_2$ (−1000, 10000) | $1000-\lvert R_1\rvert\le 0$<br>$1000-\lvert R_2\rvert\le 0$<br>$\theta_D=-\pi/3$ | $D_1=1192.3$<br>$R_1=1530.7$<br>$\gamma_2=-0.35$<br>MD = 11005.0<br>$\hat{y}_T=10000.0$ | $\theta_D=-\pi/3$<br>$L_B=5763.9$<br>$L_F=1498.3$<br>$\hat{x}_T=-1000.0$ | $\gamma_1=1.23$<br>$R_2=-1908.9$ |

TABLE 1-continued

| Optimal well path to reach a geologic target from a fixed surface location defined as $P_1$ (0, 0) | | | | |
|---|---|---|---|---|
| Target | Constraints | Results | | |
| | | Path 2 | | |
| $P_2$ (−1000, 10000) | $1000 - \lvert R_1 \rvert \le 0$<br>$1000 - \lvert R_2 \rvert \le 0$<br>$\theta_D = 0$ | $D_1 = 2023.7$<br>$R_1 = 1736.0$<br>$\gamma_2 = -0.6$<br>$MD = 10344.0$<br>$\hat{y}_T = 10000.0$ | $\theta_D = 0$<br>$L_B = 5481.9$<br>$L_F = 2007.3$<br>$\hat{x}_T = -1000.0$ | $\gamma_1 = 0.04$<br>$R_2 = -1269.3$ |
| | | Initial guess 1 (Path 3) | | |
| $P_2$ (1000, 10000) | $1000 - \lvert R_1 \rvert \le 0$<br>$1000 - \lvert R_2 \rvert \le 0$<br>$\theta_D = \pi/3$ | $D_1 = 985.3$<br>$R_1 = -1217.4$<br>$\gamma_2 = 0.37$<br>$MD = 10797.0$<br>$\hat{y}_T = 10000.0$ | $\theta_D = 1.05$<br>$L_B = 6434.5$<br>$L_F = 923.8$<br>$\hat{x}_T = -1000.0$ | $\gamma_1 = -1.17$<br>$R_2 = 2772.6$ |
| | | Initial guess 2 (Path 4) | | |
| | | $D_1 = 961.6$<br>$R_1 = -2934.8$<br>$\gamma_2 = 0.67$<br>$MD = 11386.0$<br>$\hat{y}_T = 10000.0$ | $\theta_D = 1.05$<br>$L_B = 3769.04$<br>$L_F = 1321.4$<br>$\hat{x}_T = -1000.0$ | $\gamma_1 = -1.43$<br>$R_2 = 1713.1$ |
| | | Initial guess 3 (Path 5) | | |
| | | $D_1 = 1309.3$<br>$R_1 = -3436.7$<br>$\gamma_2 = 0.05$<br>$MD = 11556.0$<br>$\hat{y}_T = 10000.0$ | $\theta_D = 1.05$<br>$L_B = 5126.4$<br>$L_F = 370.89$<br>$\hat{x}_T = -1000.0$ | $\gamma_1 = -1.36$<br>$R_2 = 1523.9$ |

Figure 6:
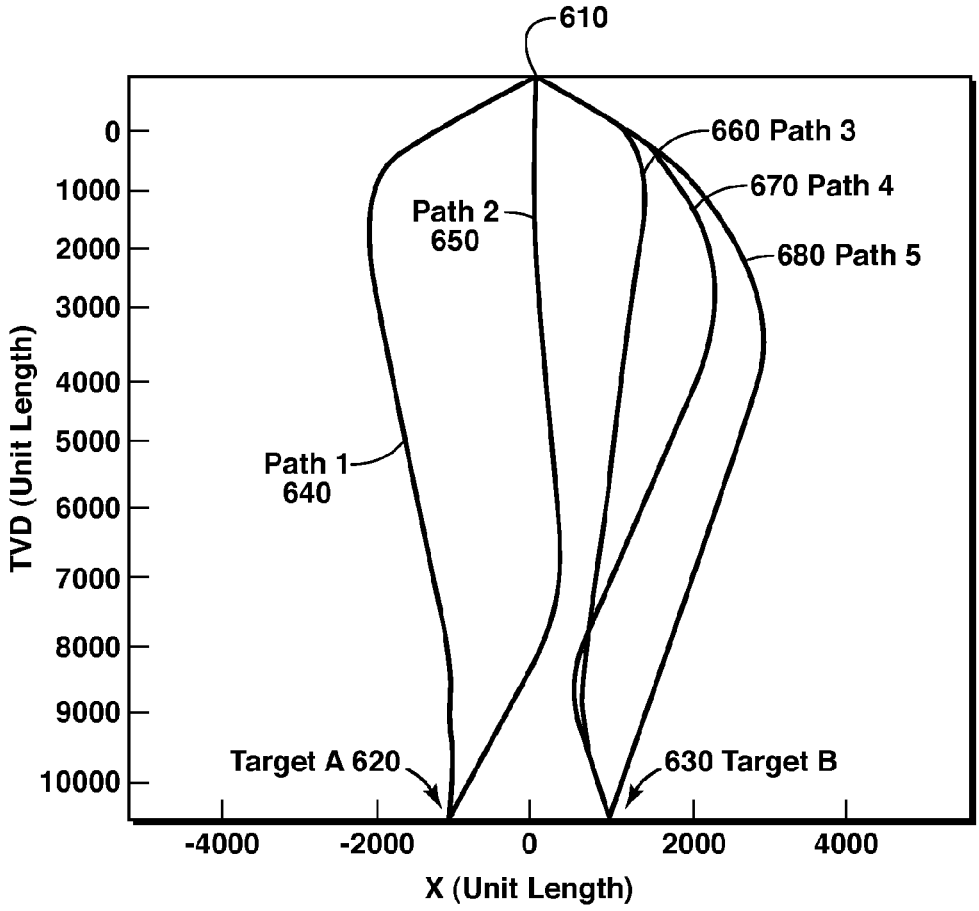
FIG. 6 illustrates the calculated wellbore paths for various constraints and initial guesses in accordance with certain exemplary embodiments of the invention.

FIG. 6 illustrates the calculated wellbore paths for various constraints and initial guesses in accordance with an exemplary embodiment of the invention. As expected, the results are quite sensitive to the weights $\alpha_{L,k}$ and $\alpha_{\Delta,k}$ that combine the multi-criteria: well path length and deviation from target into a weighted sum. The optimal well path to reach Target A, $P_2$(−1000, 10000), 620 from a fixed surface location, $P_1$(0, 0), 610, using the constraints $1000-|R_1|\le 0$, $1000-|R_2|\le 0$, and $\theta_D=-\pi/3$, is illustrated by Path 1 640. The optimal well path to reach Target A, $P_2$(−1000, 10000), 620 from a fixed surface location, $P_1$(0, 0), 610, using the constraints $1000-|R_1|\le 0$, $1000-|R_2|\le 0$, and $\theta_D=0$, is illustrated by Path 2 650. The optimal well path to reach Target B, $P_2$(1000, 10000), 630 from a fixed surface location, $P_1$(0, 0), 610, using the constraints $1000-|R_1|\le 0$, $1000-|R_2|\le 0$, and $\theta_D=\pi/3$, is illustrated by Path 3 660, wherein a first initial guess is made. The optimal well path to reach Target B, $P_2$(1000, 10000), 630 from a fixed surface location, $P_1$(0, 0), 610, using the constraints $1000-|R_1|\le 0$, $1000-|R_2|\le 0$, and $\theta_D=\pi/3$, is illustrated by Path 4 670, wherein a second initial guess is made. The optimal well path to reach Target B, $P_2$(1000, 10000), 630 from a fixed surface location, $P_1$(0, 0), 610, using the constraints $1000-|R_1|\le 0$, $1000-|R_2|\le 0$, and $\theta_D=\pi/3$, is illustrated by Path 5 680, wherein a third initial guess is made. As seen in FIG. 6, the optimal well path may be determined based upon an initial guess.

Figure 7:
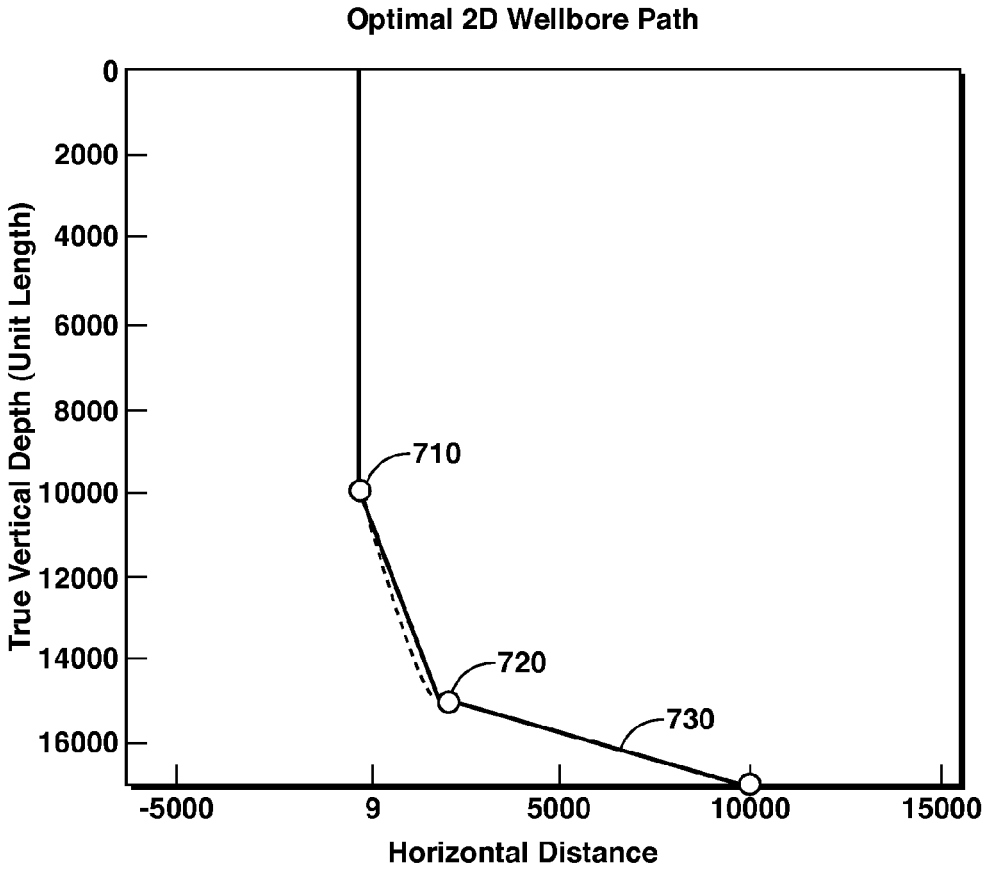
FIG. 7 illustrates an optimal well path passing through three geological targets in accordance with certain exemplary embodiments of the invention.

FIG. 7 illustrates an optimal well path passing through three geological targets in accordance with an exemplary embodiment of the invention. The above formulation, shown in Table 1, was also used to calculate optimal well paths reaching a set of geologic targets: first target $P_2$ (−500, 1000) 710, second target $P_3$ (1500, 15000) 720, and third target $P_4$ (10000, 17000) 730. The solution, illustrated in FIG. 7, was obtained using the Bellman's principle of optimality in solving the dynamic programming model in equations (11) and (12). Each optimal cost-to-go function was numerically solved using the FMINCON function in the mathematical software tool marketed by The Mathworks, Inc. of Natick, Mass. under the trademark "MATLAB."

In the above example, only certain geometric constraints are imposed in the optimization model. There are only a subset of geometric constraints that the general framework permit. Such geometric constraints include, but are not limited to, restrictions on the number and length of the trajectory segments, restrictions on the inclination angle, and restrictions on kickoff point depth.

It is understood that variations may be made in the foregoing without departing from the scope and spirit of the invention. For example, the teachings of the present illustrative embodiments may be used to enhance the computational efficiency of other types of n-dimensional computer models.

Although illustrative embodiments of the present invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope and spirit of the invention.

What is claimed is:

1. A method comprising:

receiving data relevant to drilling and completion of an oil or gas well, and to reservoir development; and simultaneously calculating well trajectory and drilling and completion decision parameters by using a computer-based model that accounts for an uncertain parameter to optimize an objective function that generates a plan for drilling and completion of one or more oil or gas wells, wherein the objective function optimizes one or more performance metrics that include reservoir performance, well drilling performance, and financial performance, subject to satisfying constraints on the drilling; and wherein the model comprises a Markov decision process-based model and wherein the using of the computer based model comprises solving the equation:

$$L(\tilde{x}_{K+1}, \tilde{u}_K, \tilde{\omega}_K) = \sum_{k=1}^{K} l(x_k, u_k, \omega_k) + l_{K+1}(x_{K+1})$$

where $\tilde{x}_{K+1}=(x_1, x_2, \ldots, x_{K+1})$ is history of states;

$X_{k+1}(x_k,u_k)=\{x_{k+1}\epsilon X|\exists\omega_k\epsilon\Omega(X_k,u_k)$ such that $x_{k+1}=f(x_k, u_k,\omega_k)\}$ is the drilling process model;

$\tilde{u}_K=(u_1, u_2, \ldots, u_K)$ is history of action variables; and $\omega_K=(\omega_1, \omega_2, \ldots, \omega_K)$ is the history of the environment variables.

2. The method of claim 1, wherein the model comprises a Stochastic decision process-based model.

3. The method of claim 1, wherein the step of receiving data comprises receiving known parameters and the uncertain parameter, and wherein the calculating includes processing the known parameters and the uncertain parameter with a Markov decision process-based model.

4. The method of claim 1, wherein an uncertainty space is associated with at least some the received data, and wherein processing the received data via the model comprises considering and entire uncertainty space.

5. The method of claim 1, wherein the model comprises a Markov decision process-based model comprising:

a plurality of stages, each stage representing a discrete step in time;

a plurality of states in each stage, each state representing a potential state of the well trajectory and drilling or completion plan; and a plurality of transition probabilities, each transition probability representing an uncertainty in the data, each transition probability being determined by a current state of the well trajectory and drilling or completion plan and a decision to be taken, wherein a future state is determined from the transition probability.

6. The method of claim 5, wherein a decision-maker is allowed to undertake one or more corrective decisions at each of the plurality of stages within the Markov decision process-based model.

7. The method of claim 1, wherein the step of receiving data comprises receiving data in real time from one or more sources.

8. The method of claim 7, wherein the one or more sources comprises at least one of sensors, analysis of rock cuttings or drilling and bore data, or well logs.

9. The method of claim 7, further comprising generating a modified well trajectory and drilling or completion plan in response to processing the received real-time data via the model.

10. The method of claim 7, further comprising implementing a modified well trajectory and modified drilling or completion plan in response to processing the received real-time data via the model.

11. A method comprising:

receiving data relevant to drilling or completion plans, wherein the data includes an uncertain parameter;

executing a portion of one or more well trajectories and one or more drilling or completion plans while accumulating real-time data;

updating uncertainty in the uncertain parameter after systematically processing new information collected in real-time;

simultaneously calculating remaining well trajectory and drilling and completion decision parameters by using a computer-based model that takes into account the uncertain parameter, to optimize an objective function, wherein the objective function optimizes one or more performance metrics that include reservoir performance, well drilling performance, and financial performance, subject to satisfying constraints on the drilling; and wherein the computer-based model comprises a Markov decision process-based model and wherein the using of the computer based model comprises solving the equation:

$$L(\tilde{x}_{K+1}, \tilde{u}_K, \tilde{\omega}_K) = \sum_{k=1}^{K} l(x_k, u_k, \omega_k) + l_{K+1}(x_{K+1})$$

where $\tilde{x}_{K+1}=(x_1, x_2, \ldots, x_{K+1})$ is history of states;

$X_{k+1}(x_k,u_k)=\{x_{k+1}\epsilon X|\exists\omega_k\epsilon\Omega(X_k,u_k)$ such that $x_{k+1}=f(x_k, u_k\omega_k)\}$ is the drilling process model;

$\tilde{u}_K=(u_1, u_2, \ldots, u_K)$ is history of action variables; and $\omega_K=(\omega_1, \omega_2, \ldots, \omega_K)$ is the history of the environment variables.

12. The method of claim 11, the computer-based model comprises the uncertain parameter by capturing tradeoffs across a plurality of realizations of uncertainty associated with the uncertain parameter.

13. The method of claim 11, wherein the model comprises considering an entire uncertainty space.

14. The method of claim 11, further comprising:

systemically processing the uncertain parameter within the computer-based model; and systemically processing well trajectory within the computer-based model, wherein one or more solutions to the well trajectory and drilling or completion plan, and the reservoir development plan are determined in parallel.

15. A method comprising:

receiving data relevant to drilling and completion of an oil or gas well, and to reservoir development; and simultaneously calculating well trajectory and drilling and completion decision parameters by using a computer-based model that accounts for an uncertain parameter to optimize an objective function that generates a plan for drilling and completion of one or more oil or gas wells, wherein the objective function optimizes one or more performance metrics that include reservoir performance, well drilling performance, and financial performance, subject to satisfying constraints on the drilling; and drilling one or more wells according to output from the drilling plan, completion plan, or reservoir development plan; and wherein the computer-based model comprises a Markov decision process-based model and wherein the using of the computer based model comprises solving the equation:

$$L(\tilde{x}_{K+1}, \tilde{u}_K, \tilde{\omega}_K) = \sum_{k=1}^{K} l(x_k, u_k, \omega_k) + l_{K+1}(x_{K+1})$$

where $\tilde{x}_{K+1}=(x_1, x_2, \ldots, x_{K+1})$ is history of states;

$X_{k+1}(x_k,u_k)=\{x_{k+1}\epsilon X|\exists\omega_k\epsilon\Omega(X_k,u_k)$ such that $x_{k+1}=f(x_k, u_k,\omega_k)\}$ is the drilling process model;

$\tilde{u}_K=(u_1, u_2, \ldots, u_K)$ is history of action variables; and $\omega_K=(\omega_1, \omega_2, \ldots, \omega_K)$ is the history of the environment variables.

16. The method of claim 15, wherein the model comprises considering an entire uncertainty space and the uncertainty space specifies inherent uncertainty of the uncertain parameter.

17. The method of claim 15, wherein the calculating includes simultaneously calculating the well trajectory, the drilling decision parameter, and the completion drilling parameter.

18. The method of claim 1, wherein the uncertain parameter is determined by a probability model dependent on state space and action space, the state spacing comprising one or more of state of drilling, hole geometry, cuttings accumulation, or conditions of drill bit, and the action space comprising one or more of well trajectory, pump rate, weight-on-bit, rotation speed, drilling fluid density, or viscosity.

19. The method of claim 1, wherein the objective function is additionally optimized to minimize at least one of cost, well path deviation from targets, or time, subject to satisfying constraints on the drilling.

20. The method of claim 1, wherein the objective function is additionally optimized to minimize well path deviation from targets, subject to satisfying constraints on the drilling.

21. The method of claim 1, wherein the objective function is optimized so that a resulting well path intersects multiple targets.

22. The method of claim 1, wherein the one or more performance metrics include drilling time, rate of penetration, well control events, mechanical failures, total cost of drilling, wellbore length, and wellbore pay zones.

* * * * *